United States Patent [19]

Beymer

[11] Patent Number: 4,552,042

[45] Date of Patent: Nov. 12, 1985

[54] TIGHTENING APPARATUS

[76] Inventor: Dale A. Beymer, 11 E. Avenida De Las Flores, Thousand Oaks, Calif. 91360

[21] Appl. No.: 635,800

[22] Filed: Jul. 30, 1984

[51] Int. Cl.[4] ..... B25B 23/14

[52] U.S. Cl. ..... 81/476; 81/473

[58] Field of Search ..... 81/473, 476; 464/30, 464/26, 24, 10

[56] References Cited

U.S. PATENT DOCUMENTS

| | | | |
|---|---|---|---|
| 1,373,810 | 4/1921 | Hansen | 464/30 |
| 2,742,805 | 4/1956 | Nelson | 81/473 |
| 3,208,316 | 9/1965 | Scribner | 81/476 |
| 3,319,494 | 5/1967 | Ulbing | 81/476 |
| 3,511,349 | 5/1970 | Herscorici | 464/26 |

*Primary Examiner*—James L. Jones, Jr.
*Attorney, Agent, or Firm*—Jack C. Munro

[57] ABSTRACT

A shaft tightening apparatus wherein the shaft can be tightened a multitude of times to the same level of torque. The tightening apparatus comprises an exterior housing which when manually pivoted will similarly pivot within an internally located spindle. This spindle is fixedly mounted to the shaft. Upon a certain level of torque being obtained, the housing will completely pivot relative to the spindle with a further tightening force not being obtainable.

6 Claims, 4 Drawing Figures

TIGHTENING APPARATUS

BACKGROUND OF THE INVENTION

The field of this invention relates to a tightening apparatus and more particularly to a shaft tightening apparatus for a vise in which the same tightening force can be applied to a workpiece contained within the vise each time the shaft is tightened.

A machine tool is a power driven machine for shaping metal by a series of repeated cuts. A typical machine tool is a shaper, planer, milling machine, lathe, jig bore, drillpress, automatic screw machine, etc. Each one of these machines has a workpiece supporting surface. The workpiece supporting surface includes a vise within which is to be located the workpiece which is fixedly mounted within the vise. Tightening of the vise occurs through the use of a screw assembly which is manually turned to move movable jaws relative to fixed jaws. This vise has a pair of movable jaws so as to clamp the workpiece tightly in both the "X" and the "Y" directions.

Some types of machine tools are capable of performing machining operations with a high degree of accuracy. At the present time it is not uncommon to grind a surface of a workpiece to one hundred thousandths of an inch. It is common to manufacture a plurality of the parts that are being made. Accuracy of construction of each part is of the utmost importance.

The typical procedure for mounting a workpiece into the vise of a machine tool is to manually apply a desired level of torque through a handle assembly to the movable jaws of the vise to secure the workpiece in place. However, when working with a high degree of accuracy, even if the workpiece is solid metal, that unless each workpiece is clamped at precisely the same degree of force, there will be a slight bowing of one workpiece with respect to another which will cause the plurality of reproduced parts to not be exactly the same.

There is a need to construct a tightening device for movable jaws of a vise of a machine tool so that the jaws can be tightened to an exact level of tightening force each and every time it is tightened.

SUMMARY OF THE INVENTION

The tightening apparatus of this invention provides for a socket which is formed within a spindle. The socket is to be fixedly secured to a shaft which is to be tightened by being rotated. A spindle is mounted within a housing. There is formed a chamber between the spindle and the housing. Withing this chamber is to be located a belleville spring assembly. A nut is threadably mounted on a portion of the spindle. The housing also surrounds a portion of the nut with the nut being lineally fixed relative to the housing. Rotation of the nut relative to the spindle causes variance of the spring force. Manual turning of the housing will result in pivoting of the shaft mounted within the socket of the spindle unless the torque required to turn the shaft is exceeded by the spring force at which time the housing will freely rotate relative to the nut. There is a modified version of the tightening apparatus in which a hydraulic chamber, plus a plurality of pistons, are utilized in lieu of the spring assembly to achieve the same application of force between the spindle and the housing.

DETAILED DESCRIPTION OF THE SHOWN EMBODIMENT

Figure 1:
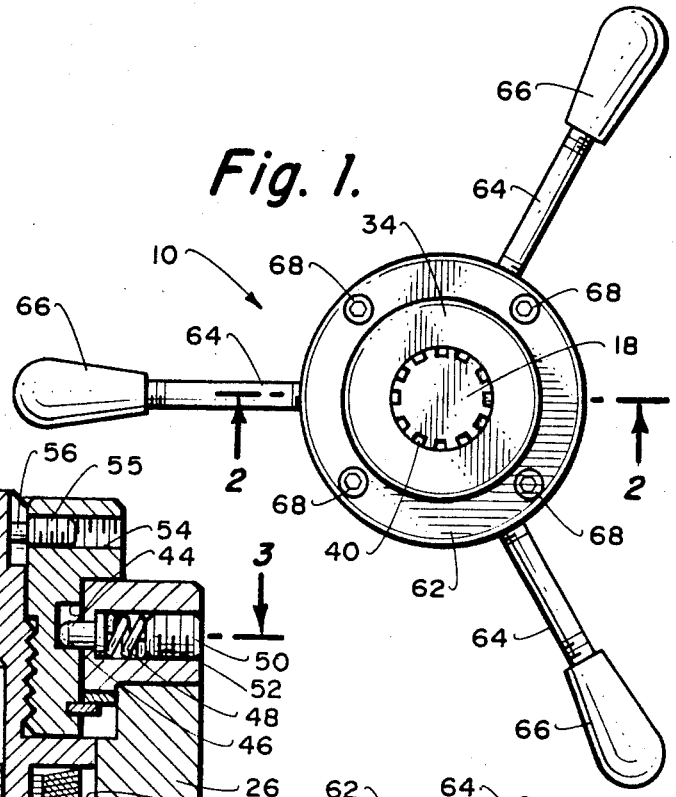
FIG. 1 is a top plan exterior view of the tightening apparatus of this invention.

Referring particularly to the drawings, there is shown the first embodiment of tightening apparatus 10 of this invention. Within the first embodiment 10 there is included a socket 12 which has an irregular shaped interior opening 14. The opening 14 is to connect in a snug fitting manner with a similar irregular shaped surface of the end of the shaft 22. The shaft 22 is to be connected to the movable jaw of a vise (not shown).

The socket 12 has a circular exterior configuration. The socket 12 is fixedly mounted by a set screw 16 within an opening 20 of spindle 18. The uppermost end of the spindle 18 includes a plurality of keyway recesses 40. The function of the recesses 40 will be explained further on in this specification.

Integrally attached to the exterior surface of the spindle 18 is an annular flange 32. Annular flange 32 is lineally movable within an annular chamber 24. The chamber 24 is closed by lip 30 of a housing 26.

Within the chamber 24 is located a spring assembly which is known as a belleville spring assembly 28. The belleville spring assembly 28 abuts against a washer 29. The washer 29 is to be formed of a frictional grabbing material. A desirable type of material would be material from which conventional brake pads are manufactured.

A portion of the exterior surface of the spindle 18 includes a series of screw threads 38. These threads 38 connect with a series of threads 36 formed within the interior opening 37 of a nut 34. The nut 34 is fixed as to lineal movement by means of ring 58 which abuts against washer 60 which in turn is abutted against cover 62. The ring 58 is mounted within an annular recess formed within the exterior surface of the nut 34. The exterior surface of the nut 34 fits in a close fitting manner within opening 70 formed within the cover 62. The nut 34 is freely rotatable or pivotable within the opening 70. The cover 62 is fixedly mounted to the housing 26 by means of a plurality of conventional fasteners 68.

Threadably connected to the cover 62 are a plurality of elongated threaded rods 64. The outer free end of each of the rods 64 is covered by means of a resilient tip 66. It is to be noted that there are three in number of the rods 64 which are located equiangularly spaced-apart about the cover 62. However, the exact number of the rods 64 is deemed to be a matter of choice and can be either increased or decreased. The rods 64 and the covers 66 function as a graspable handle assembly to facilitate manual turning of the apparatus 10.

Figure 2:
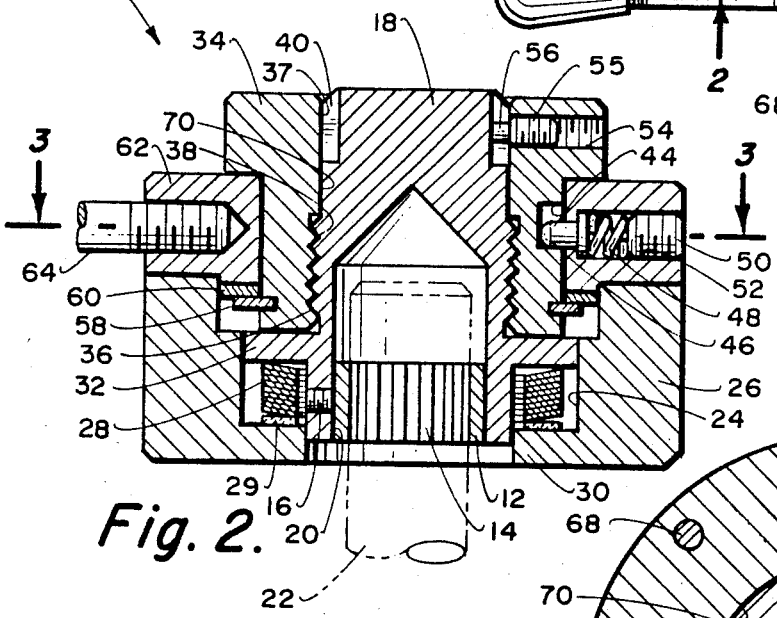
FIG. 2 is a cross-sectional view taken along line 2—2 of FIG. 1.

Threadably mounted within the opening 54 formed within the nut 34 is a set screw 55. The set screw 55 terminates in a smaller diameter tip 56. The tip 56 is capable of engaging with any one of the keyways 40. With the tip 56 disengaged from a keyway 40, the operator can manually rotate the spindle 18 relative to the nut 54. This manual turning in relation to FIG. 2, will cause the flange 32 to be moved toward the lip 30 hence compressing spring assembly 28. As a result, a greater spring force is obtained which locks together the housing 26 and the spindle 18. On the desired amount of force being obtained, which is to be accomplished through experience in the operating of the device 10, the operator then turns set screw 54 until tip 56 is located within one of the keyways 40. At this time a particular amount of compressing of the spring assembly 28 has been obtained and will remain until spindle 18 is again rotated with respect to the nut 34.

With the device 10 installed on the shaft 22, the operator proceeds to manually rotate the entire device 10 through the use of the manual grasping of the rods 64 and the tips 66. This turning will occur until the shaft 22 is not able to be rotated any further. At this time the cover 62 will pivot relative to the nut 34 and also the housing 26 will pivot relative to the spindle 18. This pivoting tells the operator that further tightening motion would be to no avail and that the desired amount of tightening torque has been obtained.

When it is desirable to rotate the shaft 22 in the reverse direction, the operator then rotates the cover 62 in the counterclockwise direction. However, this reverse rotation will only initially cause rotation of the cover 62 and the housing 26 and not the spindle 18. Therefore, in order to achieve rotation of the spindle 18, which in turn will cause the shaft 22 to be loosened. A ratchet assembly in the form of a pin 46 which is mounted within opening 52 of the cover 62 is caused to engaged with shoulder 61 formed within cover 34. It is to be noted that tightening action merely causes the pin 46 to ride over cam surface 44. It is further to be noted that there is another cam surface 42 located diametrically opposite the cam surface 44. Associated with the cam surface 42 is a shoulder 59. The pin 46 is to be connectable with either the shoulder 61 or the shoulder 59.

The pin 46 is continuously biased by a spring 48 to the extended position. A set screw 50 is located within the opening 52 and abuts against the outer end of the spring 48. With the pin 46 abutting against either should 59 or 61, further rotation of cover 62 will result in overcoming the biasing force of the spring assembly 28 and loosening of the shaft 22.

Figure 4:
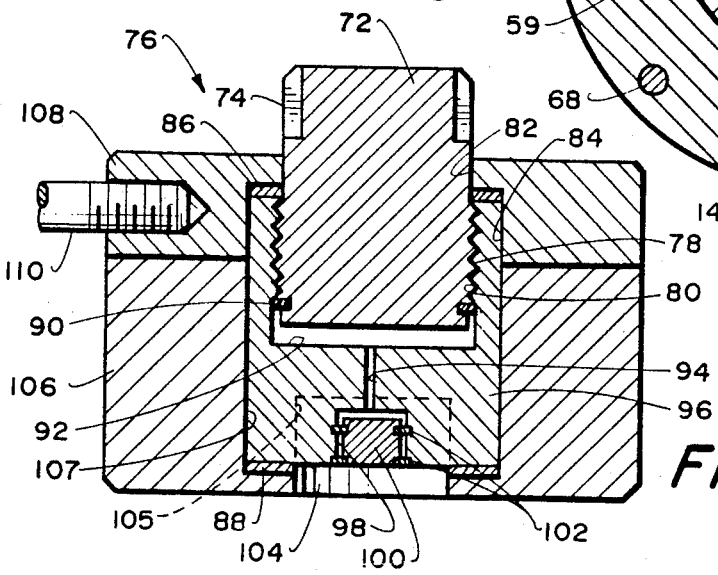
FIG. 4 is a cross-sectional view similar to FIG. 2 but of the modified form of the tightening apparatus of this invention which utilizes hydraulics to achieve the application of force as opposed to the spring assembly utilized in FIG. 2.

Referring particularly to FIG. 4 of the drawing, there is shown a similar type of tightening apparatus 76 in which there is located a nut 72 the outer end of which includes a plurality of keyways 74. The keyways 74 are similar to keyways 40. The inner end of the nut 72 includes a series of screw threads 78. The screw threads 78 threadingly engage with threads 80 formed within a spindle 96. The spindle 96 rests within an opening 84 formed within cover 108. The upper end of the spindle 96 abuts against a frictionally grabbing washer 86. Manual rotation of the apparatus 76 is caused through the use of rods 110 which are similar to rods 64.

The cover 108 is fixedly mounted by fasteners (similar to fasteners 68) to the housing 106. Formed within the housing 106 is an enlarged opening 107. This main portion of the spindle 96 rests within the opening 107. The lower surface of the spindle 96 abuts against friction grabbing washer 88.

The inner end of the nut 72 is located within a chamber 92. Within the chamber 92 is to be located a quantity of liquid such as oil (not shown). Leakage of the oil from the chamber 92 past the threaded connection 78 and 80 is prevented by means of seal 90.

It is noted that the nut 72 includes a smaller diametered section which connects with smaller diametered opening 82 formed within the cover 108. Centrally disposed within the housing 106 is a socket 105. The socket 105 includes an irregularly shaped surface similar to surface 14. Access into the socket 105 is by means of a shaft similar to shaft 22. Access would be through opening 104 formed within the housing 106.

Located about the socket 105 and spaced therefrom within the housing 106 are a plurality (preferably three in number) are pistons 100. Each piston 100 is to abut against washer 88. Each piston 100 forms a liquid tight connection by means of seal 102 within a cylinder 98. An orifice 94 connects each cylinder 98 to the chamber 92.

Figure 3:
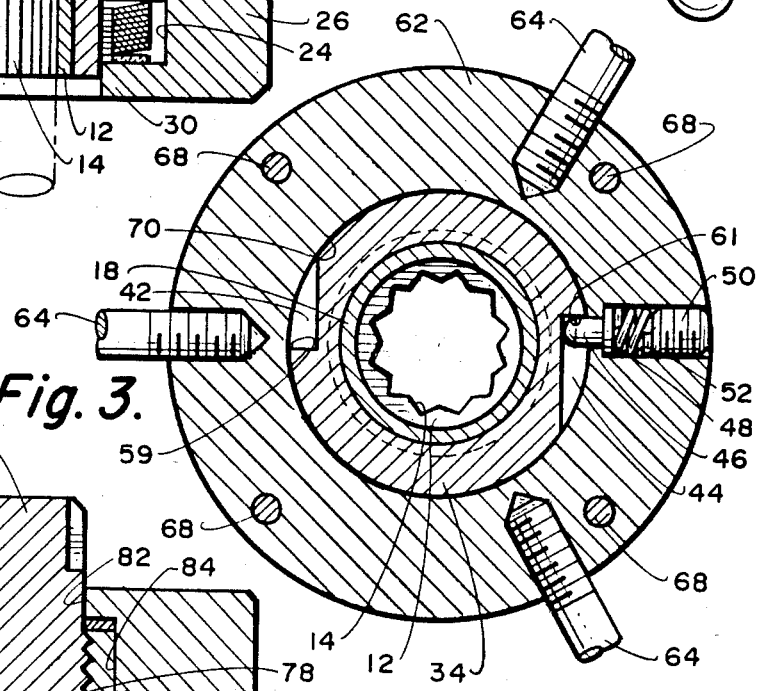
FIG. 3 is a cross-sectional view taken along line 3—3 of FIG. 2.

From the operator turning of the nut 72 by means of a separate tool which is to engage with keys 74, the size of the chamber 92 is varied in size. If the size of the chamber 92 is decreased in size, the liquid within chamber 92 is conducted through each of the orifices 94 to within each of the piston cylinders 98. This in turn causes each of the pistons 100 to slightly extend to be tightly pressed against the washer 88. Again, as in the embodiment described in FIGS. 1 to 3, a biasing force is created between the spindle 96 and the housing 106. Any tightening force applied to the rods 110 will be transferred through the spindle 96 to the shaft connected to the sockets 105 as long as the applied torque has not overcome the force applied by the pistons 100 against the washer 88. Upon this force having been overcome, rotational movement will occur between the cover 108 and the housing 106 relative to the spindle 96.

What is claimed is:

1. A tightening apparatus comprising:

a spindle, said spindle having a socket adapted to be rotatably connected to a shaft;

a housing located about said spindle, said spindle being capable of pivoting relative to said housing;

a spring chamber formed between said spindle and said housing, a spring assembly located within said spring chamber, said spring assembly exerting a force between said spindle and said housing;

a nut threadably mounted on said spindle, said housing being located about said nut, said nut being capable of rotative movement relative to said housing, said nut being lineally fixed in position relative to said housing, rotation of said nut causes lineal movement of said spindle varying the size of said spring chamber hence altering the compression of said spring assembly changing said force; and handle means attached to said housing, said handle means facilitating manual rotation of said housing which will also cause rotation of said spindle tending to produce a tightening force, upon said tightening force reaching a certain value said housing pivots relative to said spindle.

2. The tightening assembly as defined in claim 1 wherein:

said spring assembly comprising belleville springs.

3. The tightening apparatus as defined in claim 1 including:

a ratchet assembly connected to said housing, said ratchet assembly to connect with said nut, said ratchet assembly permitting rotation of said nut in one direction while fixing together of said nut and of said housing during rotation of said nut in the opposite direction.

4. A tightening assembly comprising:

a spindle, said spindle having a socket adapted to be rotatably connected to a shaft;

a housing located about said spindle, said spindle being capable of rotation relative to said housing, a frictional contacting surface formed between said housing and said spindle;

a nut threadably mounted on said spindle, said housing being located about said nut, said nut being capable of rotative movement relative to said housing;

an enclosed fluid chamber formed between said spindle and said nut, a liquid contained within said fluid chamber, a piston assembly connected with said frictional contacting surface, said piston assembly being mounted within said spindle, said piston assembly being forced into contact with said frictional contacting surface by said liquid under pressure within said fluid chamber, rotation of said nut causes lineal movement between said nut and said spindle varying the size of said fluid chamber resulting in flow of said liquid causing movement of said piston assembly varying the contacting force of said piston assembly onto said frictional contacting surface; and handle means attached to said housing, said handle means facilitating manual rotation of said housing which will also cause rotation of said spindle producing a tightening force, upon said tightening force reaching a certain value said housing pivoting relative to said spindle.

5. The tightening apparatus as defined in claim 4 wherein:

said frictional contacting surface comprising two separate spaced-apart surfaces with one said surface being located at one end of said spindle with the other said surface being located at the opposite end of said spindle.

6. A tightening apparatus as defined in claim 5 wherein:

said two separate surfaces each being annular in configuration.

* * * * *